US008277003B2

(12) United States Patent
Milligan et al.

(10) Patent No.: US 8,277,003 B2
(45) Date of Patent: Oct. 2, 2012

(54) UNDERMOUNT DRAWER SLIDE

(75) Inventors: Charles A. Milligan, Haceinda Heights, CA (US); Quinn Chi, El Monte, CA (US)

(73) Assignee: Accuride International Inc., Santa Fe Springs, CA (US)

( * ) Notice: Subject to any disclaimer, the term of this patent is extended or adjusted under 35 U.S.C. 154(b) by 0 days.

(21) Appl. No.: 11/269,439

(22) Filed: Nov. 7, 2005

(65) Prior Publication Data

US 2006/0097609 A1 May 11, 2006

Related U.S. Application Data

(60) Provisional application No. 60/625,555, filed on Nov. 5, 2004.

(51) Int. Cl.
*A47B 88/00* (2006.01)

(52) U.S. Cl. ..... 312/334.6; 312/334.33

(58) Field of Classification Search ..... 312/334.6, 312/334.27, 334.32, 334.33, 334.38, 334.13, 312/334.31, 334.14–334.18; 384/18–20
See application file for complete search history.

(56) References Cited

U.S. PATENT DOCUMENTS

| | | | | | |
|---|---|---|---|---|---|
| 2,805,107 | A | * | 9/1957 | Van De Warker et al. | 384/449 |
| 4,351,575 | A | * | 9/1982 | Rock et al. | 384/18 |
| 4,752,142 | A | | 6/1988 | Jackson et al. | |
| 4,799,802 | A | * | 1/1989 | Lautenschlager | 384/19 |
| 4,921,359 | A | * | 5/1990 | Sakamoto | 384/18 |
| 4,955,160 | A | * | 9/1990 | Rock | 312/334.8 |
| 5,344,227 | A | * | 9/1994 | Rock et al. | 312/334.6 |
| 5,344,228 | A | * | 9/1994 | Kovarik et al. | 312/334.9 |
| 5,570,943 | A | | 11/1996 | Schröder et al. | |
| 5,769,518 | A | | 6/1998 | Grabher | |
| 5,775,788 | A | * | 7/1998 | Sasse et al. | 312/334.38 |
| 5,851,059 | A | * | 12/1998 | Cirocco | 312/334.11 |
| 5,895,101 | A | | 4/1999 | Cabrales et al. | |
| 6,132,020 | A | * | 10/2000 | Schael et al. | 312/334.1 |

(Continued)

FOREIGN PATENT DOCUMENTS

EP 0 406 647 A2 1/1991

OTHER PUBLICATIONS

International Search Report dated Sep. 25, 2006 for International Application No. PCT/US2005/40492, filed Nov. 7, 2005, International Search Report mailed Nov. 28, 2006 (3 pgs.).

(Continued)

*Primary Examiner* — Janet M Wilkens
(74) *Attorney, Agent, or Firm* — Christie, Parker & Hale, LLP

(57) ABSTRACT

A drawer slide for coupling a drawer to a cabinet includes an intermediate rail partially housed within the drawer rail and web and first and second legs which are connected to the web. A flange extends from the first leg toward the second leg. Bearings housed in bearing cages placed between the rails allow sliding movement therebetween. A cabinet rail partially housed within the intermediate rail includes an upright wall and a flange extending away from the upright wall and toward the first leg. Ball and roller bearings housed in bearing cages couple the flanges. Grooves in the flanges are engaged by the ball bearings. Roller bearings housed in bearing cages couple the web of the intermediate rail and the flange of the cabinet rail, and the second leg of the intermediate rail and the upright wall of the cabinet rail.

22 Claims, 7 Drawing Sheets

U.S. PATENT DOCUMENTS

| | | | | |
|---|---|---|---|---|
| 6,254,210 | B1 * | 7/2001 | Parvin | 312/334.46 |
| 6,378,968 | B1 * | 4/2002 | Weng | 312/334.11 |
| 6,682,160 | B2 * | 1/2004 | Kung | 312/334.6 |
| 6,854,816 | B2 | 2/2005 | Milligan | |
| 6,854,817 | B1 * | 2/2005 | Simon | 312/334.6 |
| 6,874,942 | B2 * | 4/2005 | Yamamoto et al. | 384/492 |
| 6,945,620 | B2 * | 9/2005 | Lam et al. | 312/334.6 |
| 7,267,317 | B2 * | 9/2007 | Kato et al. | 248/429 |
| 7,320,508 | B2 * | 1/2008 | Booker et al. | 312/334.6 |
| 7,353,748 | B2 * | 4/2008 | Sato et al. | 92/165 R |
| 8,152,252 | B2 * | 4/2012 | Liang et al. | 312/334.6 |
| 2003/0197452 | A1 * | 10/2003 | Kung | 312/334.6 |
| 2004/0000851 | A1 * | 1/2004 | Harn et al. | 312/334.7 |
| 2004/0212284 | A1 * | 10/2004 | Fitz | 312/334.13 |
| 2005/0162053 | A1 * | 7/2005 | Larsen | 312/334.6 |
| 2005/0231083 | A1 * | 10/2005 | Garcie | 312/333 |
| 2007/0080616 | A1 * | 4/2007 | Lam et al. | 312/334.6 |
| 2007/0080617 | A1 * | 4/2007 | Lam et al. | 312/334.15 |
| 2011/0037365 | A1 * | 2/2011 | Liang et al. | 312/334.32 |
| 2011/0188788 | A1 * | 8/2011 | Li | 384/19 |

OTHER PUBLICATIONS

International Preliminary Report on Patentability dated May 8, 2007 for International Application No. PCT/US2005/40492, filed Nov. 7, 2005, International Preliminary Report on Patentability mailed May 18, 2007 (1 pg.).

Written Opinion of the International Searching Authority dated Sep. 25, 2006 for International Application No. PCT/US2005/40492, filed Nov. 7, 2005, Written Opinion of the International Searching Authority mailed Nov. 28, 2006 (6 pgs.).

Supplementary European Search Report dated Sep. 22, 2010 for Application No. 05 826 192.6.

* cited by examiner

FIG. 3
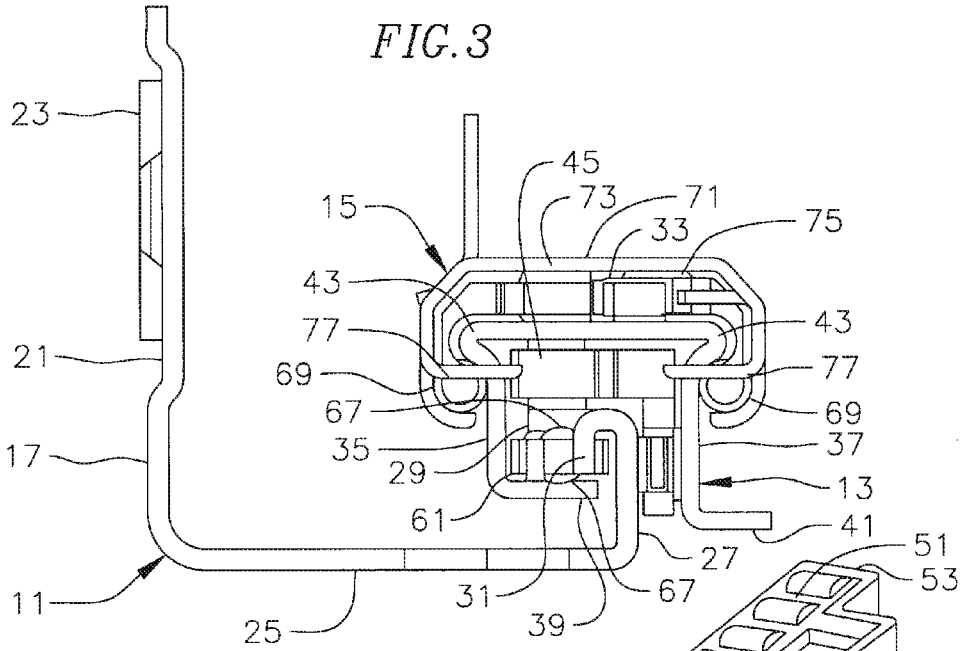
FIG. 4A
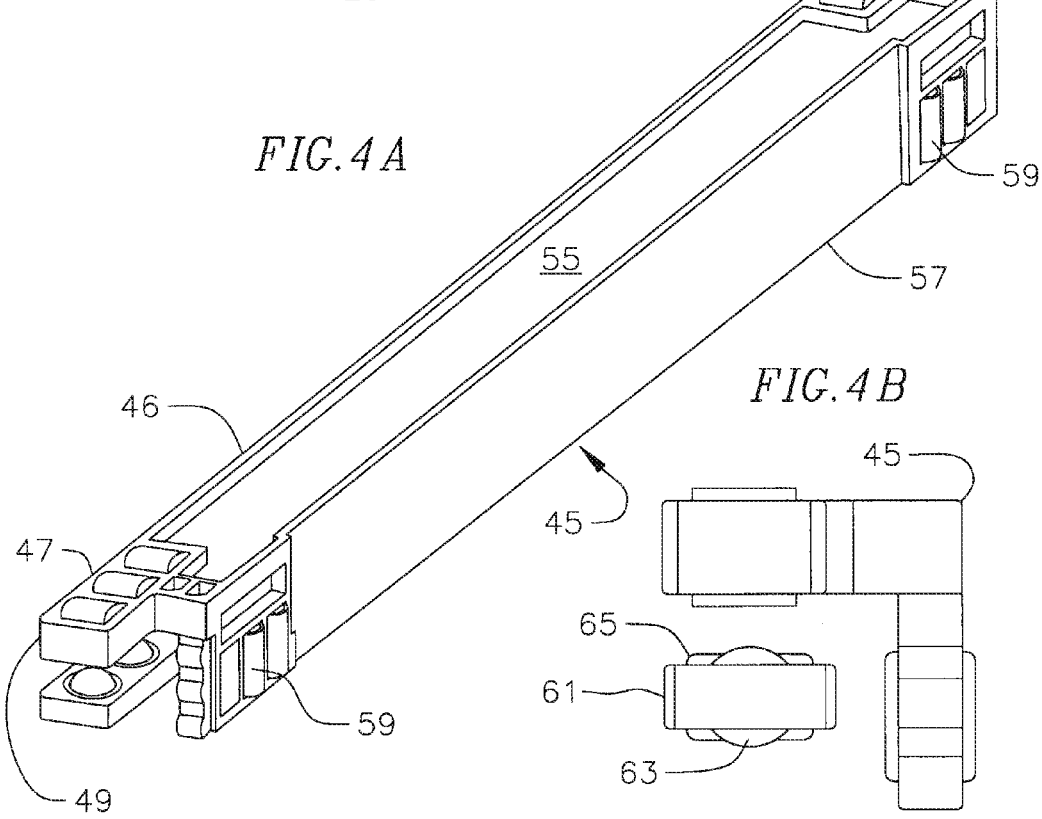
FIG. 4B

UNDERMOUNT DRAWER SLIDE

CROSS REFERENCE TO RELATED APPLICATIONS

This application claims the benefit of the filing date of Provisional Patent Application No. 60/625,555, filed Nov. 5, 2004, incorporated by reference herein.

BACKGROUND OF THE INVENTION

The present invention relates generally to drawer slides, and more specifically to undermount drawer slides.

Drawer slides are ubiquitous in cabinets, cabinet type structures, and rack mounted applications. Drawer slides are often used to extensibly attach drawers and the like to cabinets, with extension of the drawer from the cabinet allowing for easy access to the contents of the drawers. In general, drawer slides are useful in providing extensible attachment of items to structures.

An undermount drawer slide is adapted to be placed under a drawer or the like. Placement under a drawer or item may be convenient in that in use the slides generally remain hidden underneath the drawer when extended. Being placed directly under a drawer or other extensibly mounted item, however, raises design issues. For example, load bearing characteristics may be somewhat complex, particularly when a heavy drawer is extended.

In addition, in many applications the cabinet or other supporting structure is not adapted to bear loads on structural elements directly under the drawer. Instead, the cabinet or supporting structure is adapted to bear load along its side walls or a frame attached to, or part of, the side walls. In such circumstances, some means to transfer load is generally required to extend from the undermount drawer slide underneath the drawer out to the side walls of a cabinet. Such a means allows mounting of the undermount drawer slide to the side of the cabinet. The means, however, further complicates design of the undermount drawer slide, as the means must transfer the load of the drawer to the side wall, which may be some distance from other portions of the undermount drawer slide.

SUMMARY OF THE INVENTION

The invention provides an undermount drawer slide. In one aspect the invention provides a drawer slide assembly comprising a first rail comprising a longitudinal first web and side bearing raceways at opposing edges of the first web; a second rail extendably coupled to the first rail and partially housed therein, the second rail comprising a longitudinal second web, a first leg and a second leg both extending away from the second web, the first and second legs connected to the second web by folds along each longitudinal margin of the second web, and a flange extending from the first leg into a mouth defined by the two legs; a third rail extendably coupled to the second rail and partially housed between the first and second legs of the second rail, the third rail comprising an upright wall positioned between the first and second legs of the second rail, and a spur extending laterally from the upright wall within the mouth of the first rail toward the first leg of the second rail, the spur including a longitudinal groove; first ball bearings placed between the folds of the second rail and the side bearing raceways of the first rail; and second ball bearings running in the grooves of the flange of the second rail and the spur of the third rail, wherein the first rail and the second rail slide relative to one another at least partially on the first ball bearings, wherein the first ball bearings contact the first and second rails at an angle to a line defined by the second web, and wherein the second rail and the third rail slide relative to one another at least partially on the second ball bearings. In another aspect the invention provides a drawer slide assembly comprising a first rail comprising a first web and side bearing raceways at opposing edges of the first web; a second rail comprising a second web, a first leg and a second leg both extending away from the second web along longitudinal margins thereof, and a flange extending from the first leg into a mouth defined by the two legs, wherein the flange includes a groove; a third rail comprising an upright wall partially housed between the first and second legs of the second rail, a spur extending within the mouth of the second rail from the upright wall toward the first leg of the second rail, wherein the spur includes a groove; and ball bearings in the groove of the flange of the second rail and the groove of the spur of the third rail.

These and other aspects of the invention are more fully comprehended on review of the following description in conjunction with the accompanying drawings.

BRIEF DESCRIPTION OF THE FIGURES

FIG. 3 illustrates a front view of the undermount drawer slide of FIGS. 1 and 2;

FIGS. 4A and 4B illustrate perspective view and front views, respectively, of bearing cages in accordance with aspects of the invention;

DETAILED DESCRIPTION

Figure 1:
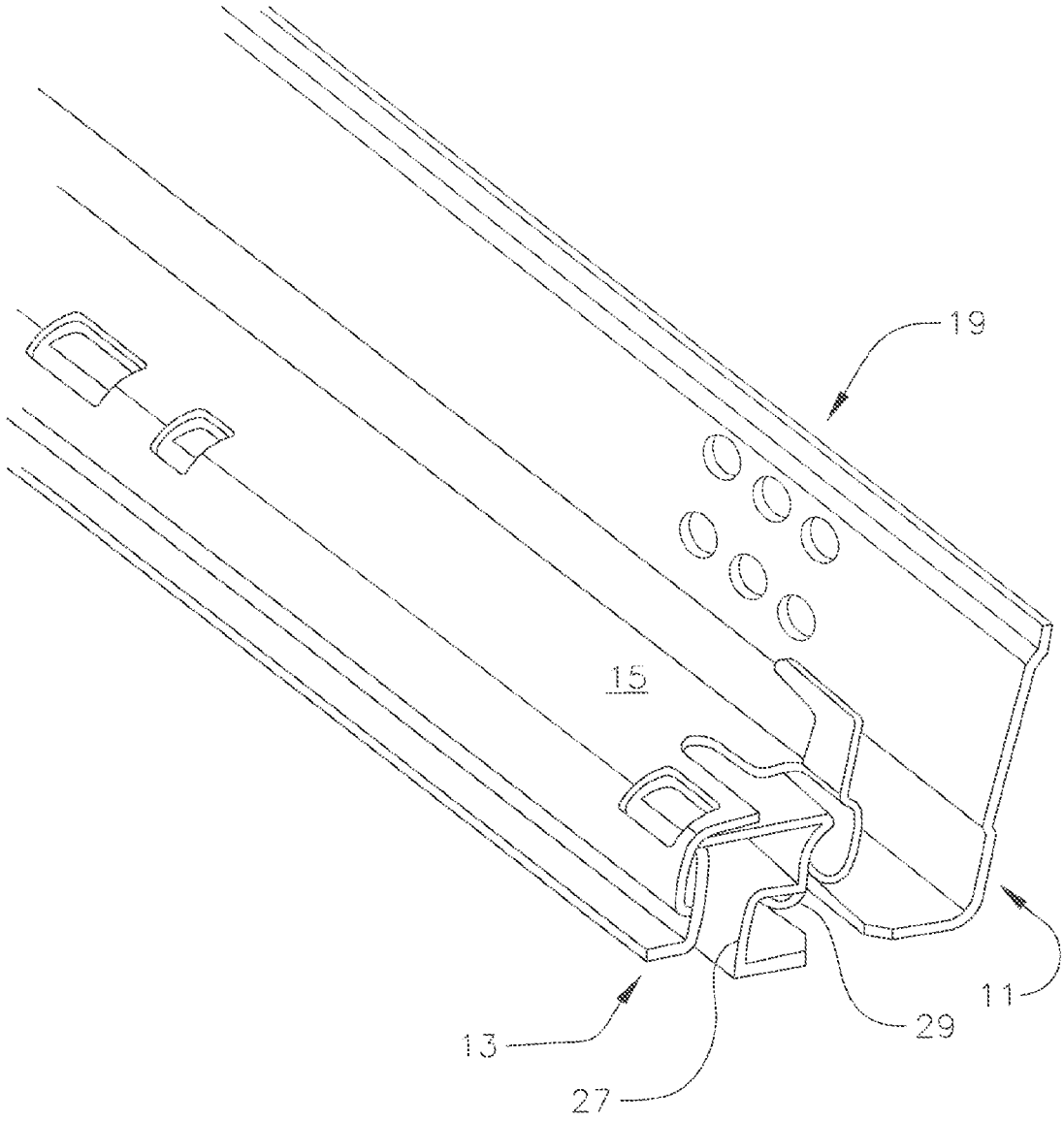
FIG. 1 illustrates a partial perspective view of an undermount drawer slide in accordance with aspects of the invention.
Figure 2:
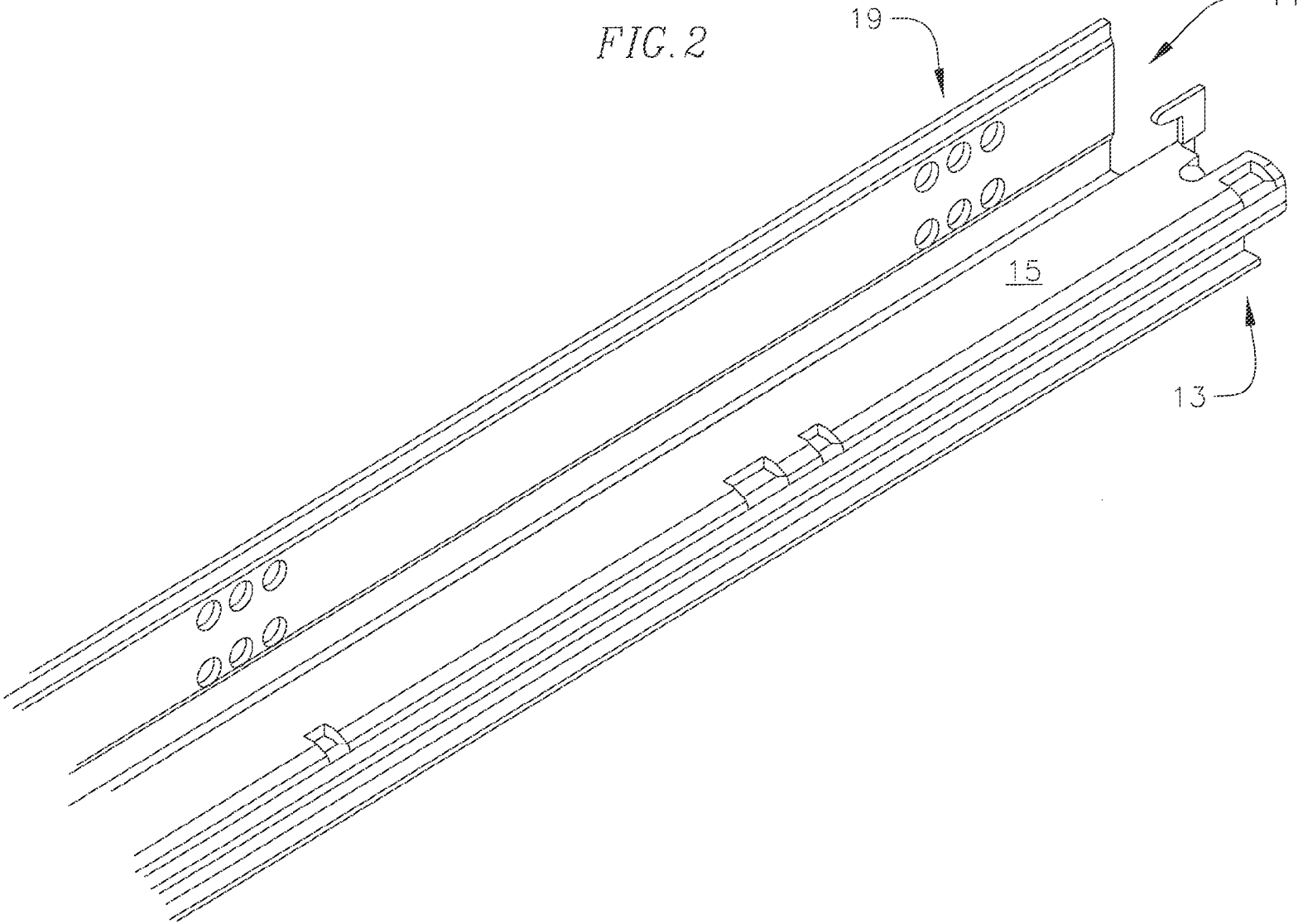
FIG. 2 illustrates a further perspective view of the undermount drawer slide of FIG. 1.

FIGS. 1, 2, and 3 illustrate a partial perspective view, a perspective view and a front view, respectively, of an undermount drawer slide in accordance with aspects of the invention. With reference to FIG. 1, the undermount drawer slide includes three rails. The rails include a cabinet rail 11 adapted for mounting to a side of a cabinet, an intermediate rail 13 coupled to the cabinet rail, and a shelf rail 15 coupled to the intermediate rail. The shelf rail is adapted for connection with a drawer or shelf or the like.

The cabinet rail, which is integrally formed, includes an L-shaped portion extending away from the intermediate rail. A first part 17 of the L-shaped portion, distal from the intermediate rail, is used for coupling to a side of the cabinet. In the embodiment of FIG. 1, the first part of the L-shaped portion includes patterned mounting holes 19. The patterned mounting holes are convenient in that at times cabinets are configured to receive mounting screws and the like in pre-positioned locations. The pre-positioned locations may vary from cabinet to cabinet and across manufacturers. The patterned mounting holes shown in FIG. 1 provide mounting points corresponding to a great many of the pre-positioned locations used in cabinetry.

With reference to FIG. 3, in a further embodiment, the first part of the L-shaped portion includes a recessed portion 21. Ribs 23 are formed in the recessed portion, with mounting holes providing in the ribs. A second part 25 of the L-shaped portion extends towards the intermediate rail. As illustrated, the first part and the second part of the L-shaped portion are of substantially equal width, although this may vary in various embodiments. Generally, the width of the second part of the L-shaped portion is sufficient to extend from a side of a cabinet to a distance past a sidewall of a drawer adapted to fit within the cabinet. This places a forward edge of the second part of the L-shaped portion underneath the body of the drawer, approximate locations under the drawer appropriate for mounting of undermount drawer slides.

Longitudinally along the second part of the L-shaped portion is an upright wall 27 which has a flange 29, sometimes called a spur, along its distal portion. The flange is directed towards the first part of the L-shaped portion, and may therefore be considered an inward flange as it wraps inward toward a center of the cabinet rail. A lower surface of the inward flange includes a longitudinal groove to capture ball bearings, as is discussed further below. A portion 31 of the inward flange at the front of the cabinet rail is bent downwardly to form a bearing stop.

The intermediate rail 13 is coupled to the cabinet rail 11 by way of rollers and ball bearings. The intermediate rail may be viewed as having a cross-section similar to the Greek letter pi ($\pi$), as may be seen in the cross-section of FIG. 3. Thus, the intermediate rail has a substantially flat upper portion 33, two downward legs 35, 37 slightly inset of longitudinal margins of the upper portion, an inward flange 39 extending from one of the legs and an outward flange 41 extending from the other leg. The inward and outward flanges therefore both extend in the same direction, with the inward flange extending within a mouth formed by the downward legs and an outward flange extending away from the mouth formed by the downward legs.

Folds 43, one along each longitudinal margin of the upper portion, connect the upper portion to the downward legs. The folds provide increased torsional rigidity and strength to the intermediate rail, providing for decreased deflection of the slide assembly during operation. The folds also provide bearing raceways along the outside of the intermediate rail, as is discussed more fully below. In some embodiments, and as illustrated, the folds are formed of the intermediate rail, with the folds being formed of compound curves in the material of the intermediate rail. In some embodiments inner surfaces of the folds are in contact with each other. As illustrated the folds do not extend above the upper portion of the intermediate rail, although in some embodiments the folds extend above the flat upper portion, and in some embodiments at an angle of approximately 35 degrees.

The inward flange 29 of the cabinet rail 11 is positioned within the mouth of the intermediate rail 13. Roller bearings interconnect the intermediate rail and the connector and the intermediate rail and the upper surface of the inward flange.

With reference to FIGS. 4A and 4B, as illustrated the roller bearings are maintained in a single bearing cage 45 having an L-shaped cross-section. A top portion 46 of the bearing cage includes three roller bearings 47 approximate a front 49 of the bearing cage, and three roller bearings 51 approximate a rear 53 of the bearing cage. The roller bearings are located towards an outer edge of the top of the bearing cage and have parallel axis of rotation and are linearly placed with respect to one another. The bearing cage has a substantially hollowed-out portion 55 along regions of the top of the bearing cage, and the location of the bearings juts out from the remainder of the top portion. The use of a hollowed-out portion reduces material costs somewhat, and additionally allows for some flexibility in the bearing cage structure as a whole to account for slight torsional movement of the drawer slide and to reduce bearing cage noise when the bearing cage recycles position upon contact with stops formed in the shelf rail. As is common to the bearing cages discussed herein, the bearing cages fully capture bearings inserted into the cages, increasing ease of assembly of the slide.

A side portion 57 of the bearing cage includes roller bearings 59 having a vertical axis of rotation approximate the front and the rear of the bearing cage. As illustrated in FIG. 4A, the bearing cage includes two roller bearings approximate the front of the bearing cage, and two roller bearings approximate the rear of the bearing cage.

As may be seen in FIG. 3, the roller bearings along the side of the bearing cage 45 couple an inner portion of one of the downward legs of the intermediate rail with the upright wall 27 of the cabinet rail 11.

As may be seen in FIGS. 3 and 4B, a further bearing cage 61 houses bearings coupling a lower surface of the flange of the cabinet member and the inward leg of the intermediate rail. The use of the further bearing cage, in addition to the L-shaped bearing cage, allows for the use of different materials for the different bearing cages. In some embodiments, for example, the further bearing cage is formed of a stronger, more durable plastic to allow the further bearing cage to withstand higher impact forces.

The further bearing cage houses both ball bearings 63 and roller bearings 65. The roller bearings largely provide vertical support for the drawer assembly, particularly between the intermediate rail and the cabinet rail. The ball bearings run in grooves 67 formed in the inward leg of the intermediate rail and the inward flange of the cabinet rail. Placement of the ball bearings in the grooves provide lateral support between the intermediate rail and the cabinet rail.

Additionally, in some embodiments the ball bearings are a metal, such as steel. The use of steel ball bearings is beneficial in that steel bearings undergo minimal compression under expected loads for the slide assembly, and thereby reduce deflection of the slide assembly, particularly when the slide assembly is extended.

With reference to FIG. 3, the shelf rail 15 is a C-shaped rail having side bearing raceways 69 interconnected by a web 71. The web transitions to the raceways with somewhat rounded edges. The somewhat rounded edges, which form a chamfer, provide clearance for material, such as glue, which may be present on an underside of a drawer or shelf coupled to the shelf rail. The shelf rail extends about the upper portion of the intermediate rail, encompassing the folds of the intermediate rail. The web 71 of the shelf rail forms a raceway which is substantially flat and positioned in the slide assembly opposed to the upper portion of the intermediate rail. The side bearing raceways 69 wrap around the folds of the intermediate rail, and are adapted to receive bearings towards a front edge of the C-shaped shelf rail.

Roller bearings with a horizontal axis of rotation couple the web of the shelf rail and the upper portion of the intermediate rail. A first set of roller bearings 73 are substantially directly above the roller bearings coupling the intermediate rail and the inward flange of the cabinet rail. A second set of roller bearings 75 is offset from the first set of roller bearings, and the second set of roller bearings is substantially above the rollers coupling one of the downward legs of the intermediate rail with the upright wall of the cabinet rail.

Ball bearings 77 additionally couple the shelf rail and the intermediate rail. The ball bearings run in bearing raceways toward the front edges of the C-shaped shelf rail and raceways formed by the folds of the intermediate rail. The ball bearings substantially contact a single point on the shelf rail and a single point on the intermediate rail. The single points are located such that a line, or axis of contact, defined by the single points forms a roughly 45 degree angle with respect to the horizontal, which may be considered to be parallel to either the second part 25 of the L-portion of the cabinet rail, the upper portion of the intermediate rail, or the web of the shelf rail. The angled axis of contact, for example, provides both horizontal support and vertical support for the slide assembly.

Figure 5:
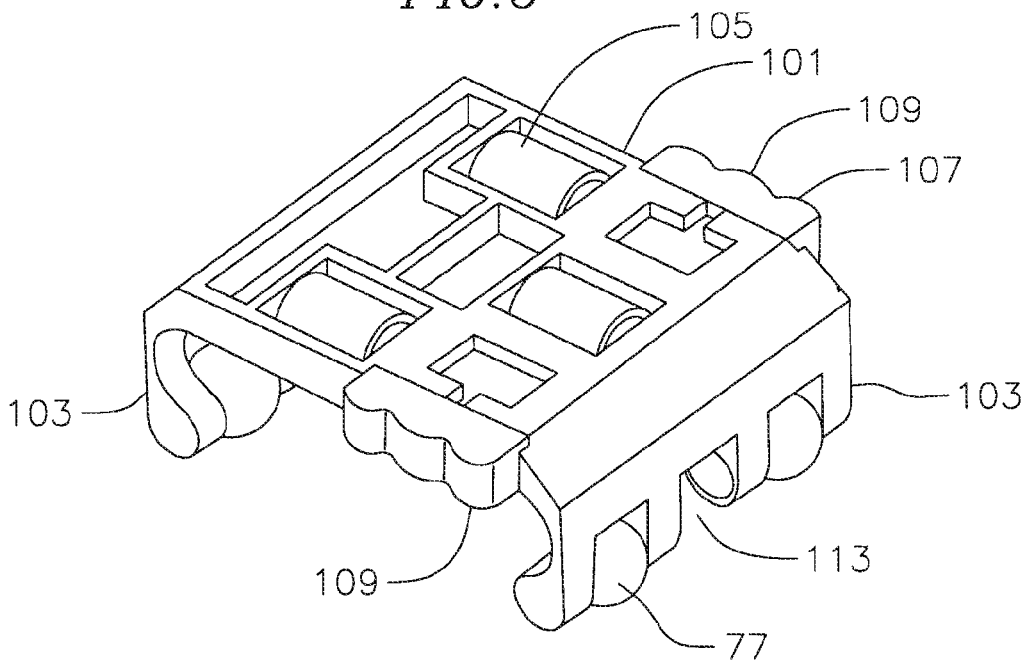
FIG. 5 illustrates a perspective view of a bearing cage in accordance aspects of the invention.
Figure 6:
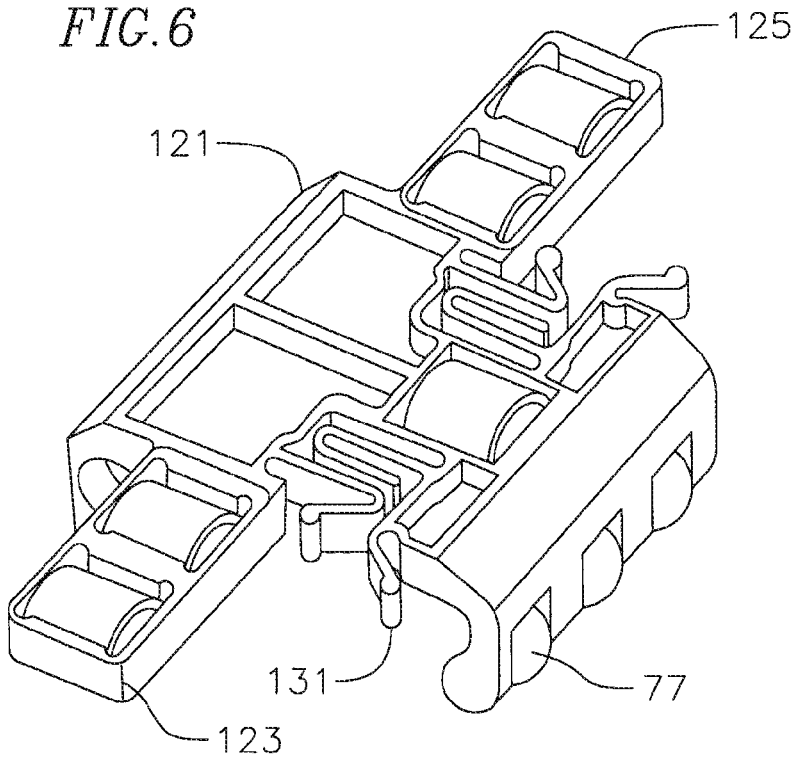
FIG. 6 illustrates a perspective view of a bearing cage in accordance with aspects of the invention.

FIGS. 5 and 6 illustrate bearing cages containing the roller bearings and the ball bearings coupling the shelf rail and the intermediate rail. In some embodiments several bearing cages of each type are used to couple the shelf rail and the intermediate rail. In various other embodiments, however, only a single version of the bearing cages are used, and in varying numbers.

The bearing cage of FIG. 5 includes a substantially square top 101 with downwardly extending arms 103. Roller bearings are embedded in the top, extending above the surface of the top and below the bottom of the top so as to allow for coupling of the shelf rail and the intermediate rail. As illustrated in FIG. 5, a pair of roller bearings 105 are linearly arranged with parallel axes of rotation along one side of the top. These roller bearings, for example, are positioned above the roller bearings coupling the inward flange and the intermediate rail member when the bearing cage is positioned within the slide assembly. The top of the bearing cage of FIG. 5 also includes a further roller bearing 107 towards the opposing side of the top. Extending outward from the top of the bearing cage, and on the side of the top towards the single roller bearing, are elastomeric bumpers 109. The elastomeric bumpers are of a material somewhat softer than the other portions of the bearing cage, and provide for softer impact during the cycling of bearing cages when the bearing cages contact bearing stops, and in the event the bearing cages contact other bearing cages, thereby reducing noise of operation of the slide.

The downwardly extending arms 103 extend downward from sides of the top of the bearing cage. The arms are configured to wrap around the folds of the intermediate rail. Ends of the arms include gaps 113 adapted to receive and retain ball bearings.

With reference to FIG. 6, an additional bearing cage is shown. In the embodiment of the slide assembly shown for example in FIG. 3, both the bearing cages of FIG. 5 and FIG. 6 are utilized. The bearing cage of FIG. 6, like the bearing cage of FIG. 5, includes a top 121 with roller bearings. Also as with the bearing cage of FIG. 5, the bearing cage of FIG. 4 includes more roller bearings towards one side of the bearing cage than towards another side of the bearing cage. As illustrated in FIG. 6, the top includes a substantially square portion with a single roller bearing towards one side. Towards the opposing side of the top, however, the bearing cage includes a forward projection 123 and a rear projection 125. Each of the forward and rear projections each include two roller bearings.

Also as in the bearing cage of FIG. 5, the bearing cage of FIG. 6 includes downward projecting arms that approximate either side of the bearing cage. The downward projecting arms includes gaps adapted to receive and retain ball bearings.

The bearing cage of FIG. 6 also includes spring structures 131 projecting outward from the bearing cage approximate the forward and rear projections of the bearing cage. The spring structures, as illustrated in FIG. 6, are bendable strips of the material of the bearing cage, which extend slightly outward from the bearing cage and are adapted to flex upon contact with another structure or device. The bendable portions, which act in a leaf spring like manner, allow for reduced noise when the bearing cage contacts, for example, a bearing stop in the slide assembly. In addition, the spring structures may contact the elastomeric bumpers of the bearing cage of FIG. 5, and in such case would also bend and reduce noise generated by the closing of the bearing cages.

Figure 7:
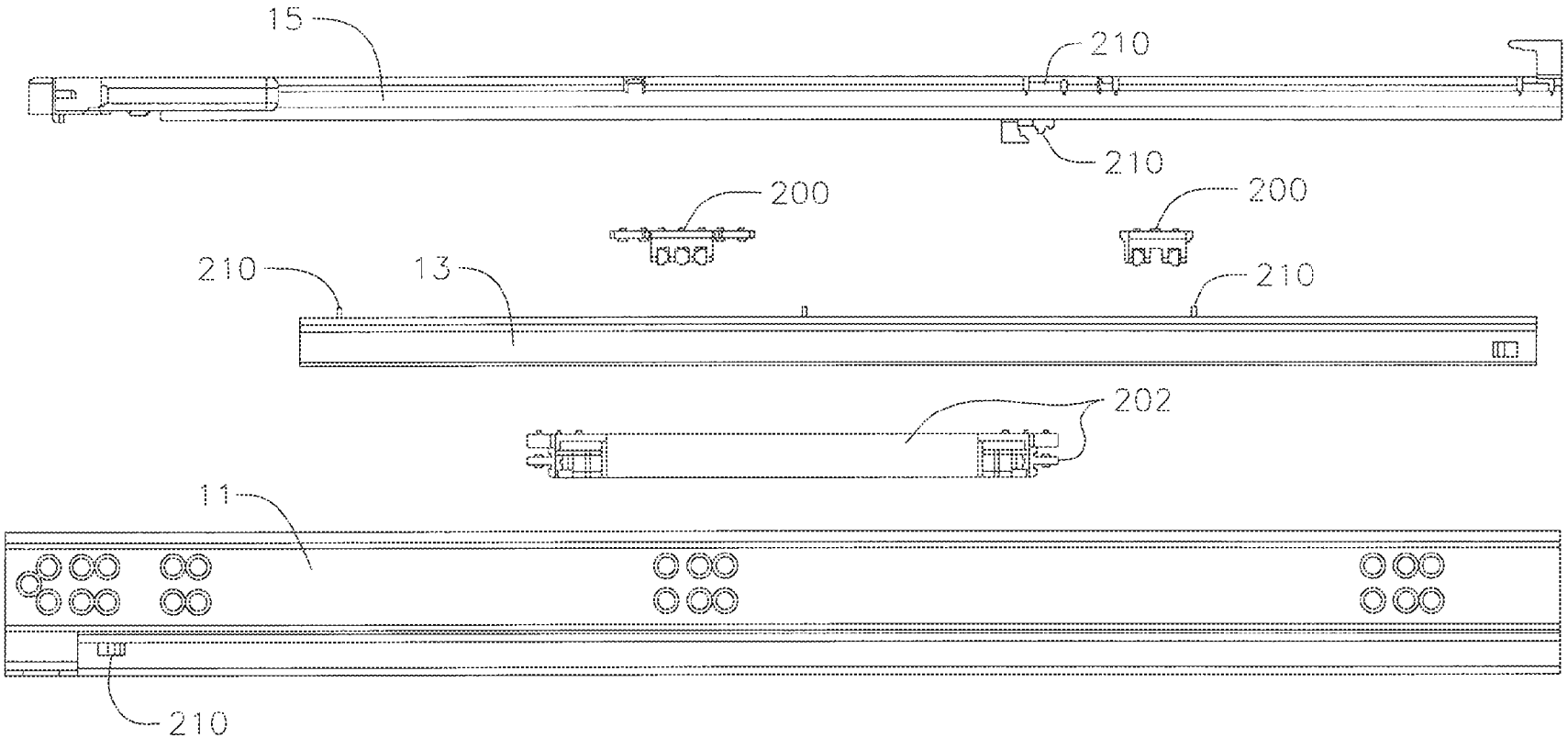
FIG. 7 illustrates an exploded view of a slide assembly in accordance with aspects of the invention.

FIG. 7 illustrates an exploded view of the slide assembly, for example, of FIG. 1. The slide assembly includes the cabinet rail 11, an intermediate rail 13, and a shelf rail 15. Bearings in first bearing cages 200 slidably, or rollably, couple the shelf rail 15 and the intermediate rail 13. Similarly, bearings in second bearing cages 202 slidably, or rollably, couple the intermediate rail 13 with the cabinet rail 11.

Figure 8A:
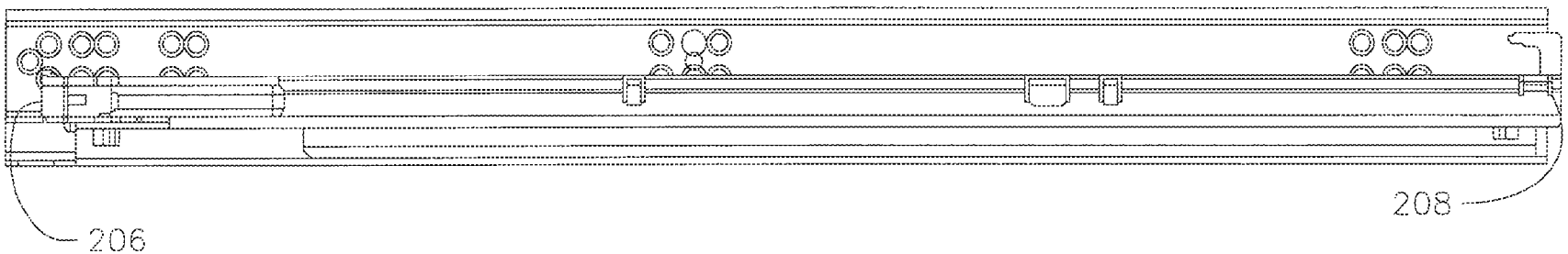
FIGS. 8A and 8B illustrate side and top views, respectively, of a slide assembly in accordance with aspects of the invention, with the slide assembly in a closed position.
Figure 8B:
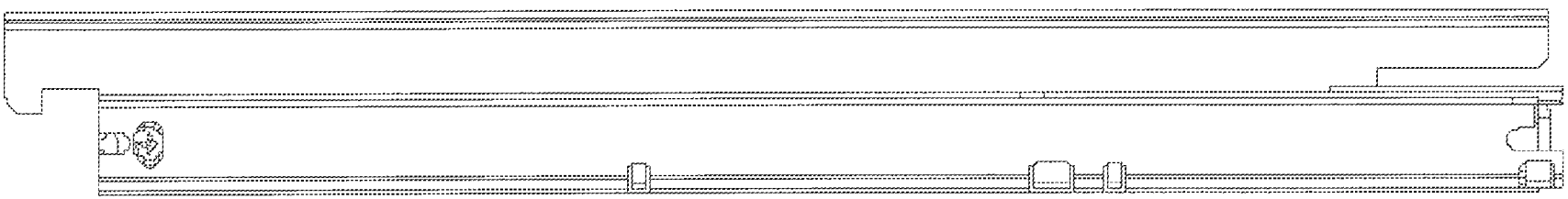
Figure 9A:
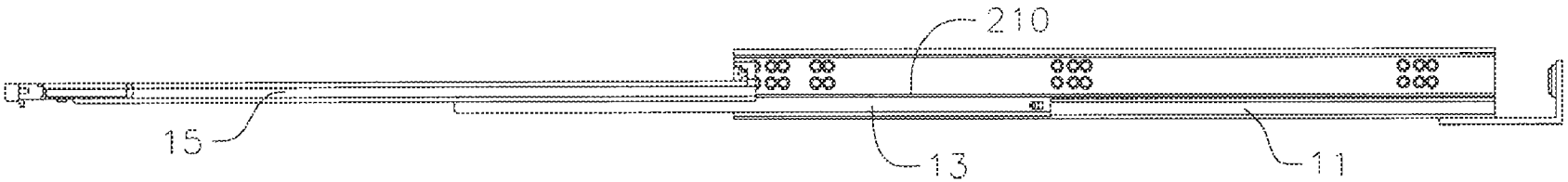
FIGS. 9A and 9B illustrate side and top views, respectively, of a slide assembly in accordance with aspects of the invention, with the slide assembly in the open position.
Figure 9B:
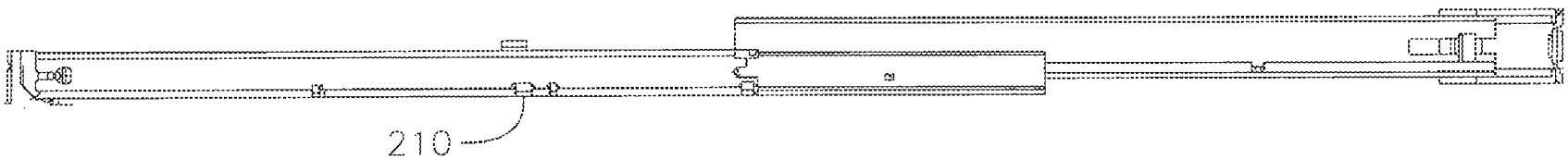

FIGS. 8A and 8B show the slide assembly in a closed position. In the closed position, the rails are positioned such that a front and rear edges (206, 208) are substantially approximate one another. FIGS. 9A and 9B show the slide assembly of FIGS. 8A and 8B in an open, or extended, position. In the extended position the shelf rail 15 extends forward from the intermediate rail 13. A portion of the shelf rail overlaps a portion of the intermediate rail, such that the portion of the intermediate rail provides support for the shelf rail. Similarly, the intermediate rail 13 extends forward from the cabinet rail 11. A portion of the intermediate rail overlaps a portion of the cabinet rail, such that the portion of the cabinet rail provides support for the intermediate rail.

In operation, in changing the slide assembly from the closed position of FIGS. 8A and 8B to the open position of FIGS. 9A and 9B, the cabinet rail 11 and shelf rail 15 may be moved away from one another in a direction of the longitudinal length of the rails, which may be considered a slide assembly extension line. This can be achieved by the movement of a member, usually a drawer, attached to the shelf rail while the cabinet rail is attached to a stationary member, usually a cabinet frame. The shelf rail extends from the intermediate rail 13 by sliding and/or rolling over the bearings in the first bearing cages (not shown).

The intermediate rail 13 extends from the cabinet rail 11 by sliding and/or rolling over the bearings in the second bearing cages (not shown). Stops 210 (also seen in FIG. 7) are generally incorporated into the rails to prevent the rails from decoupling from one another due to relative over-extension along the slide assembly extension line. The stops 210 may also serve as a barrier to ensure placement of the bearing cages between the rails, or for recycling bearing cage positions.

The drawer slide assembly may be returned to the closed position of FIGS. 8A and 8B by moving the slide rail 15 and the cabinet rail 11 toward one another along the slide assembly extension line. This can be achieved by movement of the drawer or member attached to the shelf rail while the cabinet or member attached to the cabinet rail remains stationary. The shelf rail returns to the closed position by rolling and sliding over the bearings in the first bearing cages. The intermediate rail returns to the closed position by rolling and sliding over the bearings in the second bearing cages.

Accordingly, the present invention provides an undermount drawer slide assembly and parts thereof. The invention should be viewed as the claims, and their insubstantial variations, supported by this disclosure.

The invention claimed is:

1. A drawer slide assembly comprising:

a first rail comprising a first web and a first bearing raceway opposite a second bearing raceway;

a second rail comprising a second web, a first leg and a second leg both extending away from the second web along longitudinal margins thereof, and a flange extending from the first leg toward the second leg, wherein the flange includes a groove, wherein a first fold interconnects the first leg to said second web, wherein a third bearing raceway is defined by said first fold and wherein a second fold interconnects the second leg to said second web, wherein a fourth bearing raceway is defined by said second fold;

a third rail comprising a first upright wall partially housed between the first and second legs of the second rail, a spur extending from the first upright wall toward the first leg of the second rail, wherein the spur includes a groove, the third rail further comprising a third web extending from the first upright wall and a second upright wall extending from the third web, the third web extending away from the first rail and the second rail such that the second upright wall is positioned outside the first rail and the second rail; and a first bearing cage having ball bearings each running in the groove of the flange of the second rail and the groove of the spur of the third rail for providing at least lateral support to at least one of said second and third rails;

a second bearing cage separate from the first bearing cage having bearings running between the second web of the second rail and the spur of the third rail; and at least a third bearing cage separate from the first and second bearing cages and placed between the first rail and second rail, the third bearing cage at least partially housing ball bearings slidably coupling the first rail and the second rail, wherein a first set of said ball bearings slidably coupling the first rail and the second rail are guided by the first and third bearing raceways and a second set of said ball bearings slidably coupling the first rail and the second rail are guided by the second and fourth bearing raceways for providing support to at least one of said first and second rails along two directions.

2. The drawer slide assembly of claim 1 wherein the first rail is configured for attaching to a drawer.

3. The drawer slide assembly of claim 1 wherein the third rail is configured for attaching to a cabinet.

4. The drawer slide assembly of claim 1, wherein the bearings running between the second web of the second rail and the spur of the third rail comprise horizontal roller bearings at least partially housed by the second bearing cage.

5. The drawer slide assembly of claim 1, wherein the second bearing cage houses vertical roller bearings for coupling the second leg of the second rail to the upright wall of the third rail.

6. The drawer slide assembly of claim 1, wherein the ball bearings are formed of steel.

7. The drawer slide assembly of claim 1, wherein the flange extends laterally from the first leg into a mouth defined by the first leg and the second leg so as to have a lateral portion of the flange within the mouth defined by the first leg, wherein the longitudinal groove is in the lateral portion of the flange, wherein the spur extends laterally from the first upright wall within the mouth of the second rail so as to have a lateral portion of the spur within the mouth of the second rail, and wherein the longitudinal groove is in the lateral portion of the spur.

8. The drawer slide assembly of claim 1, wherein the first bearing cage is constructed from a first material, wherein the second bearing cage is constructed from a second material different than the first material.

9. The drawer slide assembly of claim 8, wherein the first material is stronger than the second material.

10. The drawer slide assembly of claim 1, wherein the third bearing cage partially houses roller bearings and the ball bearing for coupling the first rail and the second rail.

11. The drawer slide assembly of claim 1, further comprising at least one elastomeric bumper mounted to at least the forward end or the back end of the third bearing cage.

12. The drawer slide assembly of claim 1, further comprising at least one spring structure located to at least the forward end or the back end of the third bearing cage.

13. The drawer slide assembly of claim 1, wherein the first set of ball bearings contact the first and third bearing raceways along a first angle relative to the first web, and wherein the second set of ball bearings contact the second and fourth bearing raceways along a second angle relative to the first web.

14. The drawer slide assembly of claim 13, wherein the first and second angles are each about 45 degrees.

15. The drawer slide assembly of claim 1, wherein each ball bearing of the first set of ball bearings substantially contacts the first bearing raceway at a first point and the third bearing raceway at a third point, wherein each ball bearing of the second set of ball bearings substantially contacts the second bearing raceway at a second point and the fourth bearing raceway at a fourth point, wherein when viewed in cross-section, a first line between a first and third points substantially contacted by a ball bearing extends at a first angle relative to the first web, and wherein when viewed in cross-section, a line between a second and fourth points substantially contacted by another ball bearing extends at a second angle relative to the first web.

16. The drawer slide assembly of claim 1, wherein each of said first and second angles is about 45 degrees.

17. The drawer slide assembly of claim 1, wherein each of said ball bearings between the first and second rails is bounded by the first and second rails at a horizontal diameter and at least by the first rail at a vertical diameter of said ball bearing.

18. The drawer slide assembly of claim 1, wherein each of said ball bearings between the first and second rails is bounded by the first and second rails at a first diameter and at least by the first rail along a second diameter perpendicular to the first diameter of said ball bearing.

19. The drawer slide assembly of claim 1, further comprising a stop at the end of the spur for stopping travel of the first bearing cage.

20. The drawer slide assembly of claim 19, wherein the stop stops travel of only the first bearing cage.

21. The drawer slide assembly of claim 19, wherein the stop is formed on said spur.

22. The drawer slide assembly of claim 21, wherein the stop stops travel of only the first bearing cage.

* * * * *